US007588246B2

(12) United States Patent
Kawamura

(10) Patent No.: US 7,588,246 B2
(45) Date of Patent: Sep. 15, 2009

(54) PAPER TRANSPORTATION DEVICE WITH ADJUSTABLE SEPARATING PAD HOLDER

(75) Inventor: Toshihiro Kawamura, Kyoto (JP)

(73) Assignee: Murata Machinery, Ltd., Kyoto (JP)

( * ) Notice: Subject to any disclaimer, the term of this patent is extended or adjusted under 35 U.S.C. 154(b) by 243 days.

(21) Appl. No.: 11/681,881

(22) Filed: Mar. 5, 2007

(65) Prior Publication Data

US 2007/0235919 A1 Oct. 11, 2007

(30) Foreign Application Priority Data

Apr. 6, 2006 (JP) ..... 2006-104937

(51) Int. Cl.
*B65H 3/52* (2006.01)

(52) U.S. Cl. ..... 271/124

(58) Field of Classification Search ..... 271/124, 271/121, 167; 399/367
See application file for complete search history.

(56) References Cited

U.S. PATENT DOCUMENTS

| | | | | | |
|---|---|---|---|---|---|
| 1,596,056 | A | * | 8/1926 | Mader | 271/124 |
| 1,637,833 | A | * | 8/1927 | Mueller | 271/124 |
| 4,324,396 | A | * | 4/1982 | Albright et al. | 271/125 |
| 4,394,009 | A | | 7/1983 | Bergman et al. | |
| 4,418,904 | A | * | 12/1983 | Fujimoto | 271/37 |
| 4,568,074 | A | * | 2/1986 | Murayoshi | 271/121 |
| 4,632,380 | A | | 12/1986 | Ono | |
| 4,674,737 | A | * | 6/1987 | Murayoshi | 271/124 |
| 4,978,115 | A | * | 12/1990 | Sato et al. | 271/124 |
| 5,545,882 | A | * | 8/1996 | Tanaka | 235/98 R |
| 5,927,703 | A | * | 7/1999 | Endo | 271/10.03 |
| 6,357,740 | B1 | * | 3/2002 | Inoue et al. | 271/160 |
| 6,398,209 | B1 | * | 6/2002 | Sato | 271/124 |
| 6,554,271 | B1 | | 4/2003 | Lindsay et al. | |
| 6,644,646 | B1 | * | 11/2003 | Lindsay et al. | 271/4.08 |
| 2002/0067939 | A1 | * | 6/2002 | Hamada et al. | 399/367 |

FOREIGN PATENT DOCUMENTS

| | | | | |
|---|---|---|---|---|
| DE | 3527495 | A1 | | 2/1986 |
| JP | 55035779 | A | * | 3/1980 |
| JP | 57013033 | A | * | 1/1982 |
| JP | 58052127 | A | * | 3/1983 |
| JP | 58089536 | A | * | 5/1983 |
| JP | 61162437 | A | * | 7/1986 |
| JP | 03205241 | A | * | 9/1991 |
| JP | 2005-060090 | A | | 3/2005 |

OTHER PUBLICATIONS

Official communication issued in the counterpart European Application No. 07103923.4, mailed on Aug. 7, 2007.

* cited by examiner

*Primary Examiner*—Patrick H Mackey
*Assistant Examiner*—Jeremy Severson
(74) *Attorney, Agent, or Firm*—Keating & Bennett, LLP

(57) ABSTRACT

In a paper transportation device, a separation pressure adjusting screw is provided in a transportation device main body under a separating pad holder. One end of a coil spring makes contact with the separation pressure adjusting screw, and another end of the coil spring makes contact with a position located away from a separating pad in the separating pad holder. A screw adjusting hole is provided on the separating pad holder for adjusting a screwed-in amount of the separation pressure adjusting screw from above.

19 Claims, 5 Drawing Sheets

PAPER TRANSPORTATION DEVICE WITH ADJUSTABLE SEPARATING PAD HOLDER

BACKGROUND OF THE INVENTION

1. Field of the Invention

The present invention relates to a paper transportation device for transporting paper on a paper feed tray to a paper discharge tray. In particular, the present invention relates to a paper transportation device which nips a plurality of sheets of paper picked up from the paper feed tray by a separating roller and a separating pad and separates the papers one sheet at a time.

2. Description of the Related Art

A copier, a facsimile machine, and a scanner or the like includes an image scanning device for scanning an image of an original document, and an image forming device for printing image data scanned from the original document and image data received by facsimile onto printing paper. Many image scanning devices and image forming devices include a paper transportation device, which sequentially transports a plurality of sheets of original documents or printing papers on a paper feed tray, and discharges the original documents or the printing papers onto a paper discharge tray via a prescribed image scanning position and/or an image transfer position. For example, the image scanning device includes a paper transportation device known as an Auto Document Feeder (ADF) which transports an original document from a document tray, where original documents to be scanned are set, onto a paper discharge tray, where scanned original documents are stacked.

In the ADF, as a mechanism for sequentially picking up an uppermost sheet of the original documents stacked on the document tray and feeding the original documents to a transportation path, a paper feeding unit is provided near the document tray. FIG. 4 is a schematic lateral cross-sectional view illustrating a conventional paper feeding unit 70. As illustrated in FIG. 4, the paper feeding unit 70 includes a drive shaft 71, a separating roller 72, a pickup arm 73, a pickup roller 74, a separating pad 75, a separating pad holder 76, a cork pad 77, a catching cover 78, a supporting shaft 79, a swinging bracket 80, a coil spring 81, and a separation pressure adjusting screw 82. The separating roller 72 is rotatably driven by the drive shaft 71. A base end of the pickup arm 73 is supported by the drive shaft 71. The pickup roller 74 is rotatably supported on a leading end portion of the pickup arm 73. The separating pad 75 separates a plurality of sheets of original documents picked up from a document tray (not illustrated) one sheet at a time. The separating pad holder 76 holds the separating pad 75 such that the separating pad 75 can be contacted against and separated from the separating roller 72. The cork pad 77 arranged next to the separating pad holder 76 is mounted removably on the catching cover 78. The swinging bracket 80 is provided below the separating pad holder 76 and the catching cover 78 such that the swinging bracket 80 swings with the supporting shaft 79 as a supporting point. The coil spring 81 is provided between the separating pad holder 76 and one end portion of the swinging bracket 80 on the other side of the supporting shaft 79. The separation pressure adjusting screw 82 is screwed to another end portion of the swinging bracket 80.

In the above-described paper feeding unit 70, the coil spring 81 urges the separating pad holder 76, and the separating pad 75 is contacted against the separating roller 72 under a prescribed separation pressure. Accompanying a start of rotation of the driving shaft 71, the pickup arm 73 swings downward. When the pickup roller 74 at the leading end of the pickup arm 73 rotates while making contact with the original documents, several upper sheets of the original documents among the original documents stacked on the document tray are picked up. The picked-up original documents are fed into a nip portion between the separating roller 72 and the separating pad 75. One sheet of the original documents is separated by a frictional force, and fed into the transportation path 83.

In the above-described paper feeding unit 70, when a separation failure is generated such that original documents are not separated at the nip portion and a plurality of sheets of the original documents are fed into the transportation path 83, or when a pickup failure is generated such that an original document is not fed into the transportation path 83, the separation pressure can be adjusted. That is, the cork pad 77 is removed from the catching cover 78, and a screwdriver or the like is inserted into an exposed through-hole 84 to turn the separation pressure adjusting screw 82. For example, when the separation pressure is insufficient, the separation pressure adjusting screw 82 is screwed inward. An end portion of the swinging bracket 80, which is pressed by the separation pressure adjusting screw 82, at the side of the separation pressure adjusting screw 82 is lowered, and an end portion of the swinging bracket 80 at the coil spring 81 side is elevated. Accordingly, a compressed amount of the coil spring 81 increases so as to increase its urging force. As a result, the separation pressure increases.

FIG. 5 is a schematic lateral cross-sectional view showing another conventional paper feeding unit 90. As illustrated in FIG. 5, the paper feeding unit 90 includes a separating roller 91, a separating pad 92, a separating pad holder 93, a coil spring 94, and a separation pressure adjusting screw 95. The separating pad 92 separates the original documents with the separating roller 91. The separating pad holder 93 holds the separating pad 92. The coil spring 94 urges the separating pad holder 93 to contact the separating pad 92 against the separating roller 91 under a prescribed separation pressure. The separation pressure adjusting screw 95 adjusts the separation pressure by changing a compressed amount of the coil spring 94. An inner guide unit 96 mounted with the separating pad holder 93 is arranged to be capable of swinging around a supporting shaft 97 as a swing center. Accordingly, when the separation failure is generated and it is necessary to adjust the separation pressure, as illustrated in FIG. 5, the inner guide unit 96 is swung upward to expose a bottom surface **96*a* of the inner guide unit 96. Then, a screwdriver or the like is inserted into a through-hole (not illustrated) formed on the bottom surface 96*a* to turn the separation pressure adjusting screw 95. Accordingly, a compressed amount of the coil spring 94** changes, and the separation pressure is adjusted.

However, in the paper transportation device including the conventional paper feeding unit 70, a troublesome work is required, i.e., the cork pad 77 is required to be removed from the catching cover 78 for adjusting the separation pressure adjusting screw 82. Since a center axis of the separation pressure adjusting screw 82 does not coincide with a center axis of the coil spring 81, the separation pressure cannot be adjusted under a stable state. In the paper transportation device including the conventional paper feeding unit 90, a structure for swinging the inner guide unit 96 is required.

Therefore, the complexity of the mechanism of the paper transportation device is increased, causing an increase in costs.

SUMMARY OF THE INVENTION

In order to overcome the problems described above, preferred embodiments of the present invention provide a mechanism for easily and reliably adjusting a separation pressure adjusting screw for adjusting a separation pressure in a paper transportation device in which a plurality of papers picked up from a paper feed tray are separated one sheet at a time by a separating roller and a separating pad that makes contact with the separating roller under a prescribed separation pressure.

According to a preferred embodiment of the present invention, a paper transportation device includes a transportation path, a separating roller, a separating pad, a separating pad holder, a coil spring, and a separation pressure adjusting screw. The transportation path connects a paper feed tray, where papers to be transported are stacked, and a paper discharge tray, where transported papers are discharged. The separating roller and the separating pad separate a plurality of sheets of papers picked up from the paper feed tray one sheet at a time, and feeds the papers into the transportation path one sheet at a time. The separating pad holder holds the separating pad such that the separating pad can be contacted against and separated from the separating roller. The coil spring urges the separating pad holder to contact the separating pad against the separating roller under a prescribed separation pressure. A screwed-in amount of the separation pressure adjusting screw is changed to change a compressed amount of the coil spring to adjust the separation pressure. In the paper transportation device, the separation pressure adjusting screw is provided in a transportation device main body provided under the separating pad holder. One end of the coil spring makes contact with the separation pressure adjusting screw, and another end of the coil spring makes contact with a position located away from the separating pad which is held in the separating pad holder. A screw adjusting hole is formed through the separating pad holder for adjusting the screwed-in amount of the separation pressure adjusting screw from above.

According to a preferred embodiment of the present invention, the separating pad holder is arranged to swing about a swing center located upstream of the separating pad in a paper transportation direction. One end of the coil spring makes contact with a downstream position of the separating pad holder. Further, the downstream position is located downstream of the separating pad held in the separating pad holder in the paper transportation direction.

According to a preferred embodiment of the present invention, a center axis of the separation pressure adjusting screw substantially coincides with a center axis of the coil spring.

According to a preferred embodiment of the present invention, a screwdriver or the like is inserted into the screw adjusting hole formed through the separating pad holder, and inserted into a hollow portion of the coil spring. Accordingly, the screwed-in amount of the separation pressure adjusting screw can be adjusted. The screwed-in amount of the separation pressure adjusting screw can be adjusted without removing a member such as the separating pad that covers the separation pressure adjusting screw. Therefore, an adjustment process of the separation pressure can be simplified. In addition, complexity of the mechanism of the paper transportation device is not increased.

According to a preferred embodiment of the present invention, in the paper transportation device, a distance from a position where the separating pad holder is urged by the coil spring to the swing center of the separating pad holder is longer than a distance from the separating pad to the swing center. Therefore, since an amount of change in the separation pressure of the separating pad becomes smaller than an amount of change in the urging force of the coil spring, a fine adjustment of the separation pressure can be carried out.

According to a preferred embodiment of the present invention, since the center axis of the separation pressure adjusting screw substantially coincides with the center axis of the coil spring, the separation pressure can be adjusted under a stable state in the paper transportation device.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
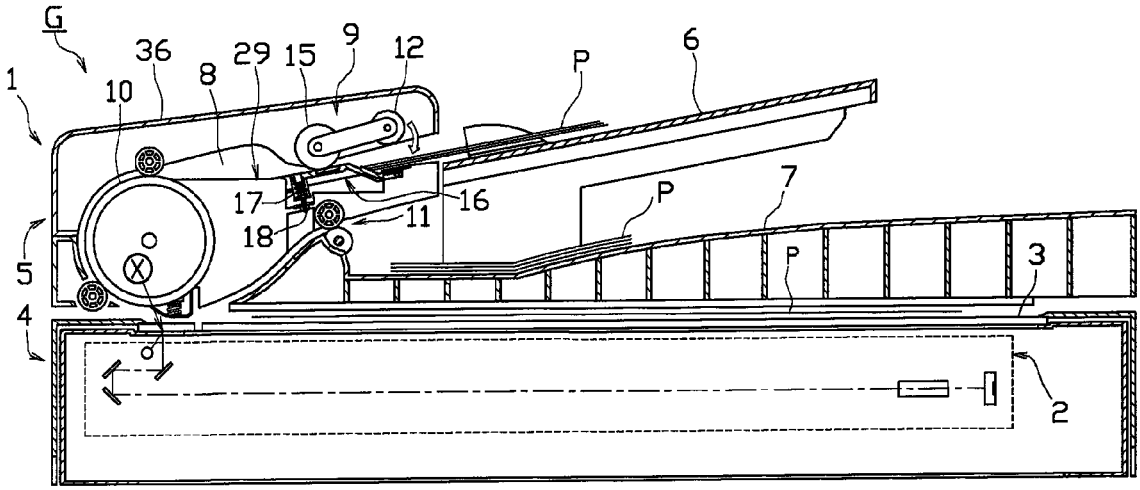
FIG. 1 is a schematic lateral cross-sectional view of an image scanning device including a paper transportation device according to a preferred embodiment of the present invention.

A paper transportation device according to preferred embodiments of the present invention will be described with reference to the drawings. FIG. 1 is a schematic lateral cross-sectional view showing a structure of an image scanning device G including an Auto Document Feeder (ADF) 1 as a paper transportation device. The image scanning device G is provided in an upper portion of a copy-and-facsimile Multi Function Peripheral (MFP) or the like. The image scanning device G is used for scanning image information of an original document to be copied and an original document to be transmitted by facsimile. The image scanning device G includes a device main body 4 and a document pressing portion 5. The device main body 4 accommodates a scanning unit 2 inside, and a platen glass 3 is arranged on an upper surface of the device main body 4. The document pressing portion 5 is arranged on the device main body 4 such that the document pressing portion 5 can be opened and closed. When scanning a thick booklet original document P or the like, the document pressing portion 5 is opened, and the original document P is placed on the platen glass 3. Then, the document pressing portion 5 is closed, and under a state in which the original document P is contacted against the platen glass 3, an image of the original document P is scanned by the scanning unit 2 moving below the platen glass 3.

As illustrated in FIG. 1, a document tray 6, a paper discharge tray 7, and the ADF 1 are provided in the document pressing portion 5. The original document P to be scanned is set on the document tray 6. After a scanning process is completed, the scanned original document P is accumulated on the paper discharge tray 7. The ADF 1 transports the original document P from the document tray 6 to the paper discharge tray 7. When scanning a plurality of sheets of original documents P, the original documents P stacked on the document tray 6 are sequentially transported by the ADF 1, and an image of the original documents P is scanned by the scanning unit 2 at a scanning position X in a transportation path 8.

As illustrated in FIG. 1, the ADF 1 includes the transportation path 8, a paper feeding unit 9, a transportation roller 10, and a discharge roller pair 11. The transportation path 8 connects the document tray 6 and the paper discharge tray 7. The paper feeding unit 9 separates the original documents P stacked on the document tray 6 one sheet at a time from an uppermost sheet, and feeds each of the original documents P into the transportation path 8. The transportation roller 10 is provided in the transportation path 8, and transports the original document P in a downstream direction. The discharge roller pair 11 is arranged at the most downstream end of the transportation path 8.

Figure 2:
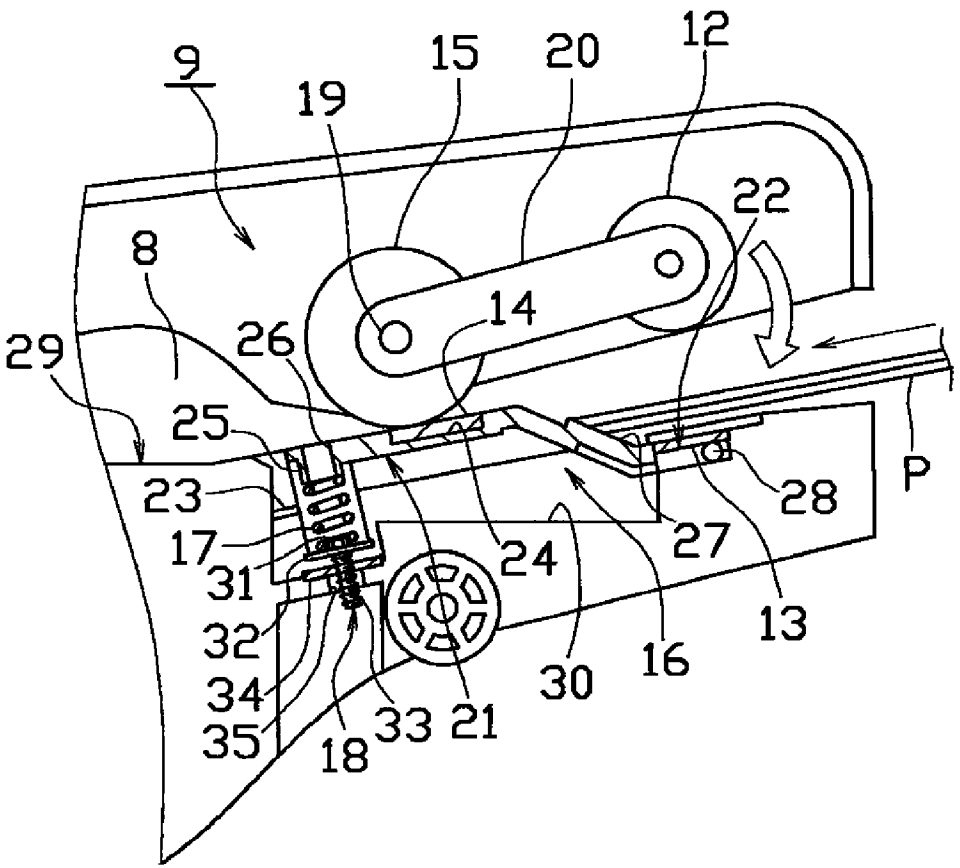
FIG. 2 is an enlarged partial lateral cross-sectional view near a paper feeding unit in FIG. 1.

FIG. 2 is an enlarged partial cross-sectional view of a portion near the paper feeding unit 9 in FIG. 1. The paper feeding unit 9 includes a pickup roller 12, a cork pad 13, a separating roller 15, a separating pad holder 16, a coil spring 17, and a separation pressure adjusting screw 18. The pickup roller 12 picks up several upper sheets of the original documents P stacked on the document tray 6. The cork pad 13 is arranged so as to face the pickup roller 12. The separating roller 15 operates with the separating pad 14 to separate only the uppermost sheet of the original documents P fed from the document tray 6. The separating pad holder 16 holds the separating pad 14 such that the separating pad 14 can be contacted against and separated from the separating roller 15. The coil spring 17 presses the separating pad 14 against the separating roller 15 under a prescribed separation pressure. The separation pressure adjusting screw 18 adjusts the separation pressure.

As illustrated in FIG. 2, the pickup roller 12 is rotatably supported on a leading end portion of a pickup arm 20. A base end portion of the pickup arm 20 is supported by a rotatable driving shaft 19. A rotational driving force of the driving shaft 19 is transmitted to the pickup roller 12 via a transmission mechanism (not illustrated) Accordingly, accompanying a start of rotation of the driving shaft 19, the pickup arm 20 swings to lower its leading end. After the pickup roller 12 makes contact with an uppermost sheet of the original documents P, the pickup roller 12 starts rotating and several upper sheets of the original documents P stacked on the document tray 6 are fed towards the separating roller 15. When only one sheet of the original documents P is remaining on the document tray 6, the original document P is nipped between the pickup roller 12 and the cork pad 13 to reliably feed the original document P into the transportation path 8.

As illustrated in FIG. 2, the separating roller 15 includes a silicone roller or the like provided around the rotatable driving shaft 19. Either a forward rotation or a backward rotation of the driving shaft 19 is transmitted to the separating roller 15 via a clutch mechanism (not illustrated). Accordingly, accompanying a start of rotation of the driving shaft 19, the separating roller 15 also starts rotating, and the original documents P picked up by the pickup roller 12 are fed into the transportation path 8. A friction coefficient of the separating pad 14 with respect to the original document P is smaller than a friction coefficient of the separating roller 15 with respect to the original document P, and higher than a friction coefficient between the original documents P. For example, the separating pad 14 is preferably made of urethane resin or other suitable material.

Next, a description will be made of how the original documents P are separated by the separating roller 15 and the separating pad 14. First, a plurality of sheets of original documents P picked up by the pickup roller 12 are nipped between the separating roller 15 and the separating pad 14. Then, since a frictional force between the lowermost original document P and the separating pad 14 is greater than a frictional force between the lowermost original document P and an upper original document P, the lowermost original document P is stopped at the separating pad 14 without being transported into the transportation path 8. The original documents P between the uppermost original document P and the lowermost original document P are stopped without being transported into the transportation path 8 since a frictional force of the original documents P with respect to the uppermost original document P and the lowermost original document P are balanced. Since a frictional force between the uppermost original document P and the separating roller 15 is greater than a frictional force between the uppermost original document P and a lower original document P, the uppermost original document P is transported towards the transportation path 8 by rotation of the separating roller 15. Accordingly, only the uppermost sheet of the original documents P is separated and sequentially transported into the transportation path 8. Then, when there is only one sheet of the original documents P left between the separating roller 15 and the separating pad 14, since a frictional force between the original document P and the separating roller 15 is greater than a frictional force between the original document P and the separating pad 14, the original document P is transported towards the transportation path 8 by the rotation of the separating roller 15. As described above, all of the original documents P picked up by the pickup roller 12 are fed into the transportation path 8.

The separating pad holder 16 includes a hollow holder main portion 21 having an opening at its bottom surface, and a pair of leg portions 22 protruding from the holder main portion 21. A pair of regulation claws 23 protrude from the holder main portion 21 in a direction opposite from the leg portions 22. A concave pad receiving portion 24 is provided in an upper surface of the holder main portion 21. The separating pad 14 is preferably adhered on the pad receiving portion 24. A spring receiving protrusion 25 is provided on an inner side surface of the holder main portion 21. A spring adjusting hole 26 is provided in an upper surface of the holder main portion 21 and penetrates through the spring receiving protrusion 25. Specifically, the spring adjusting hole 26 is formed at a position closer to the regulation claws 23 than the pad receiving portion 24. A slanting surface 27 is formed at the leg portions 22 in the holder main portion 21 and is slanted towards the separating pad 14. The original documents P stacked on the document tray 6 are displaced along the slanting surface 27, and the closely contacting original documents P are separated from each other such that the uppermost sheet can easily be separated from other sheets. Additionally, an arc-shaped swing shaft 28 is provided at an end portion of the leg portions 22 opposite from the holder main portion 21.

As illustrated in FIG. 2, the holder main portion 21 of the separating pad holder 16 is arranged in a concave portion 30 of an inner guide unit (transportation device main body) 29. Further, the concave portion 30 is located at a position facing the separating roller 15. The swing shaft 28 of each of the leg portions 22 is rotatably supported by the inner guide unit 29. Accordingly, the separating pad holder 16 can be swung around a position of the swing shaft 28 as a swing center. Although details are not illustrated in the drawings, the regulation claws 23 of the holder main portion 21 are received in a groove having a prescribed width formed on a wall surface of the concave portion 30. Accordingly, a swing range of the separating pad holder 16 is regulated within a prescribed range.

As illustrated in FIG. 2, the separation pressure adjusting screw 18 includes a head portion 31, a flange portion 32, a shaft portion 33, and a mounting portion 34. A screwdriver groove is formed in the head portion 31 for receiving a screwdriver or the like. A root portion of the head portion 31 protrudes in a peripheral direction to form the flange portion 32. A screw is formed on the shaft portion 33. The mounting portion 34 is screwed onto a prescribed position of the shaft portion 33. The separation pressure adjusting screw 18 is mounted to the inner guide unit 29 by inserting the shaft portion 33 through a through-hole 35 formed on a bottom portion of the concave portion 30 and fixing the mounting portion 34 to the bottom portion of the concave portion 30. Accordingly, by turning the separation pressure adjusting screw 18 and changing a screwed-in amount of the shaft portion 33 with respect to the mounting portion 34, a protrusion height of the separation pressure adjusting screw 18 from the bottom portion of the concave portion 30 can be adjusted. That is, by inserting the separation pressure adjusting screw 18 into the inner guide unit 29 to lower a height position of the flange portion 32, an interval between the flange portion 32 and the separating pad holder 16 is increased. Accordingly, compression of the coil spring 17 is relaxed, and the separation pressure is decreased. Additionally, by protruding the separation pressure adjusting screw 18 from the inner guide unit 29, the height position of the flange portion 32 is elevated, and an interval between the flange portion 21 and the separating pad holder 16 is shortened. Accordingly, the coil spring 17 is compressed, and the separation pressure is increased.

As illustrated in FIG. 2, one end of the coil spring 17 surrounds the head portion 31 of the separation pressure adjusting screw 18, and the coil spring 17 makes contact with the flange portion 32. Another end of the coil spring 17 makes contact with the spring receiving protrusion 25 protruding from the inner side of the separating pad holder 16. Accordingly, the separating pad holder 16 is urged upward by the coil spring 17. When the original document P does not pass through, the separating pad 14 is contacted against the separating roller 15 under a prescribed separation pressure. When an original document P picked up from the document tray 6 passes through, the separating pad holder 16 receives a downward pressing force from the original document P. Accordingly, the separating pad holder 16 swings downward around the swing shaft 28 as the swing center against the urging force of the coil spring 17 by the thickness of the original document P. Then, as described above, only the uppermost sheet is separated from the plurality of the original documents P nipped between the separating pad 14 and the separating roller 15, and fed into the transportation path 8.

According to the structure of the paper feeding unit 9 described above, when a separation failure or a pickup failure is generated due to an inappropriate separation pressure, the separation pressure can be adjusted without removing a member such as the separating pad holder 16 of the paper feeding unit 9 from the inner guide unit 29. For example, when the urging force of the coil spring 17 is strong and the separation pressure is excessive, the original document P picked up from the document tray 6 is nipped too strongly between the separating roller 15 and the separating pad 14, and a pickup failure may occur such that the original document P is not fed into the transportation path 8. When the urging force of the coil spring 17 is small and the separation pressure is too small, a separation failure may occur such that a plurality of the original documents P picked up from the document tray 6 are fed into the transportation path 8 without being separated one sheet at a time.

Figure 3:
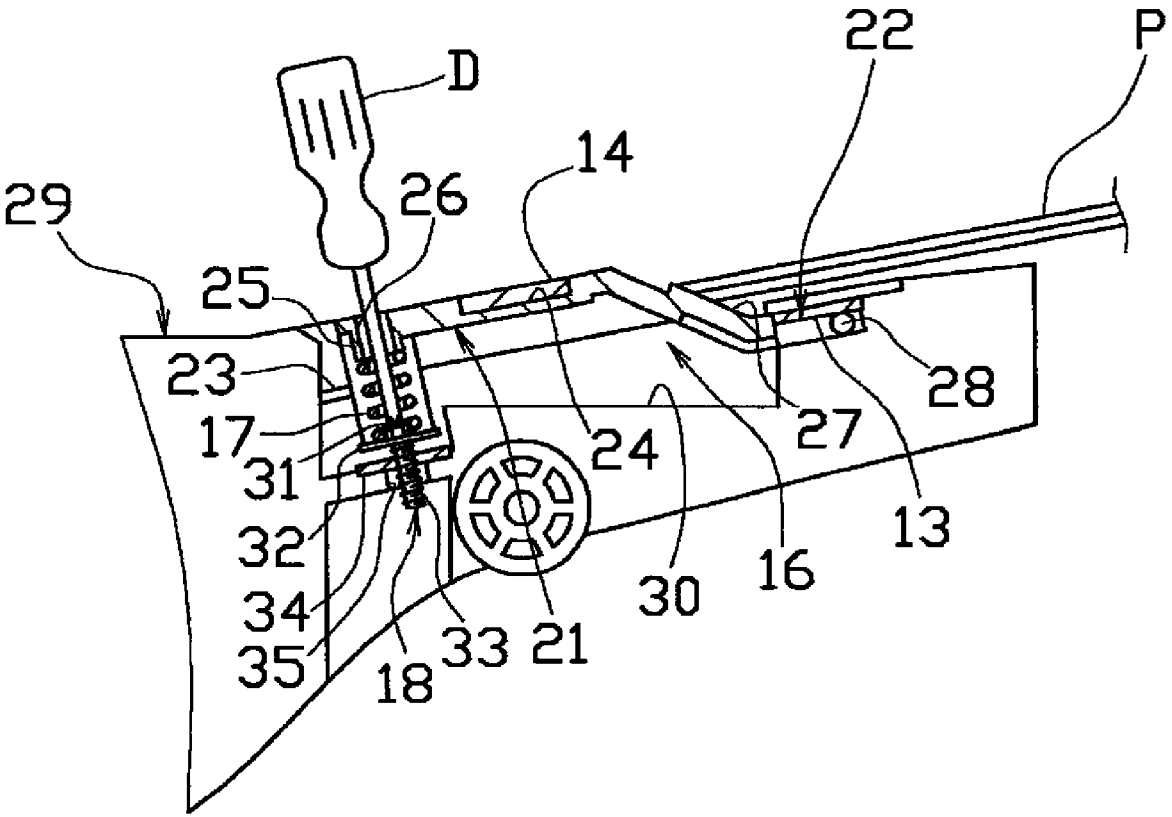
FIG. 3 is a view for describing a process for adjusting a separation pressure.
Figure 4:
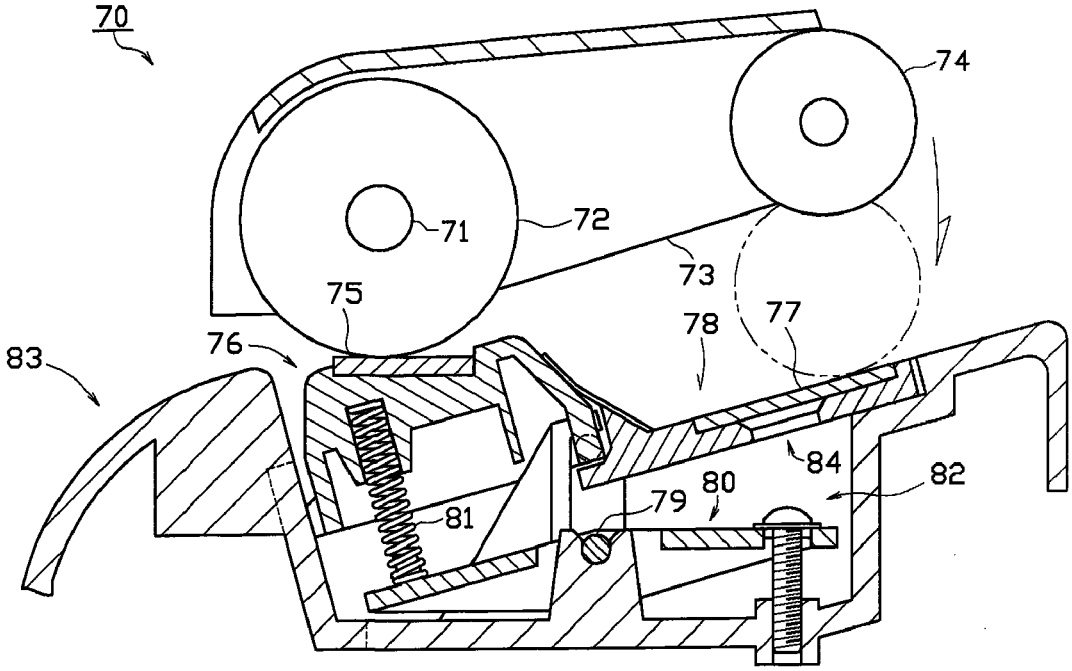
FIG. 4 PRIOR ART
FIG. 4 is a schematic lateral cross-sectional view of a conventional paper feeding unit.
Figure 5:
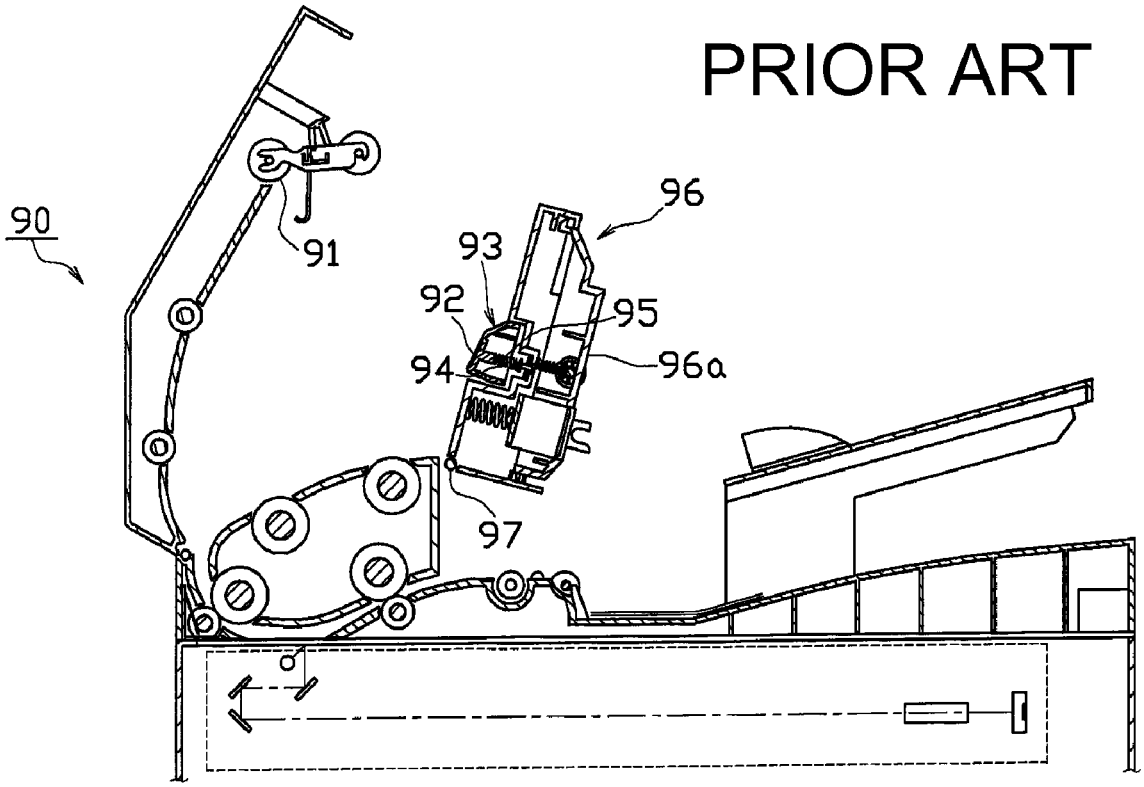
FIG. 5 is a schematic lateral cross-sectional view of another conventional paper feeding unit.

To adjust the separation pressure to an appropriate magnitude so as to solve the above-described problems, as illustrated in FIG. 3, first, an ADF cover 36 illustrated in FIG. 1 is opened, and an upper surface of the inner guide unit 29 is exposed. Then, a screwdriver D or the like is inserted into the screw adjusting hole 26 of the separating pad holder 16 and passed through the hollow portion of the coil spring 17 to be engaged in the screwdriver groove formed on the head portion 31 of the separation pressure adjusting screw 18. When reducing the separation pressure, the screwdriver D is turned to move the separation pressure adjusting screw 18 into the inner guide unit 29 to lower the height position of the flange portion 32. Accordingly, the coil spring 17, one end of which is making contact with the flange portion 32, stretches and a compressed amount of the coil spring 17 is reduced. As a result, the urging force of the coil spring 17 with respect to the separating pad holder 16 decreases causing the separation pressure to decrease. When increasing the separation pressure, the screwdriver D is turned to protrude the separation pressure adjusting screw 18 from the inner guide unit 29 to elevate the height position of the flange portion 32. Accordingly, the coil spring 17 is compressed and the compressed amount of the coil spring 17 increases. As a result, the urging force of the coil spring 17 with respect to the separating pad holder 16 increases causing the separation pressure to increase.

As described above, the separation pressure adjusting screw 18 can be adjusted without removing members such as the separating pad 14 of the paper feeding unit 9 from the inner guide unit 29. Therefore, an adjustment process of the separation pressure is simplified. Since the center axis of the separation pressure adjusting screw 18 substantially coincides with the center axis of the coil spring 17, the separation pressure can be adjusted under a stable state.

Further, in the above-described preferred embodiments, a position of the separating pad holder 16 located in a downstream side in the paper transportation direction with respect to the separating pad 14 is urged by the coil spring 17. The urged position is not limited to the above-described example, and may be located at any position if the urged position is located away from the separating pad 14. According to the urged position of the separating pad holder 16 urged by the coil spring 17, a position of the separation pressure adjusting screw 18 and the screw adjusting hole 26 can be changed. However, as in the above-described preferred embodiments, if a portion of the separating pad holder 16 located downstream of the separating pad 14 is urged, the distance from the urged position urged by the coil spring 17 to the swing shaft 28, which is the swing center of the separating pad holder 16, becomes longer than the distance from the separating pad 14 to the swing shaft 28. Therefore, an amount of change in the separation pressure of the separating pad 14 with respect to an amount of change in the urging force of the coil spring 17 becomes small. As a result, the separation pressure can be adjusted finely.

While the present invention has been described with respect to preferred embodiments thereof, it will be apparent to those skilled in the art that the disclosed invention may be modified in numerous ways and may assume many embodiments other than those specifically set out and described above. Accordingly, the appended claims are intended to cover all modifications of the present invention that fall within the true spirit and scope of the present invention.

What is claimed is:

1. A paper transportation device comprising:

a paper feed tray on which papers to be transported are stacked;

a paper discharge tray where transported papers are discharged;

a transportation path arranged to connect the paper feed tray and the paper discharge tray;

a separating roller and a separating pad arranged to separate a plurality of sheets of papers picked up from the paper feed tray one sheet at a time and to feed the papers one sheet at a time into the transportation path;

a separating pad holder arranged to hold the separating pad such that the separating pad is contacted against and separated from the separating roller;

a coil spring arranged to urge the separating pad holder to contact the separating pad against the separating roller under a prescribed separation pressure;

a separation pressure adjusting screw arranged to adjust the separation pressure by changing a compressed amount of the coil spring by changing a screwed-in amount of the screw; and a screw adjusting hole arranged in a top surface of the separating pad holder so as to adjust the screwed-in amount of the separation pressure adjusting screw from above.

2. The paper transportation device according to claim 1, wherein the separation pressure adjusting screw is arranged in a transportation device main body under the separating pad holder, and one end of the coil spring makes contact with the separation pressure adjusting screw.

3. The paper transportation device according to claim 2, wherein the separating pad holder is arranged to swing around a position of the separating pad holder located upstream from the separating pad in a paper transportation direction, and another end of the coil spring makes contact with a position of the separating pad holder located downstream from the separating pad in the paper transportation direction.

4. The paper transportation device according to claim 3, wherein a center axis of the coil spring substantially coincides with a center axis of the separation pressure adjusting screw.

5. The paper transportation device according to claim 4, wherein the separating roller is arranged to rotate about a drive shaft, and one of a forward rotation and a backward rotation of the drive shaft is transmitted to the separating roller via a clutch mechanism.

6. The paper transportation device according to claim 5, wherein a friction coefficient of the separating pad with respect to the paper is smaller than a friction coefficient of the separating roller with respect to the paper and higher than a friction coefficient between the stacked papers.

7. The paper transportation device according to claim 6, wherein the separating pad is made of a urethane resin.

8. The paper transportation device according to claim 7, wherein the separating pad holder includes:

a hollow holder main portion having an opening at a bottom surface; and a pair of leg portions protruding from the holder main portion.

9. The paper transportation device according to claim 8, wherein a pair of regulation claws protrude from the holder main portion in a direction opposite from the pair of the leg portions.

10. The paper transportation device according to claim 9, wherein a concave pad receiving portion is provided on an upper surface of the holder main portion to receive the separating pad on the pad receiving portion.

11. The paper transportation device according to claim 10, wherein a spring receiving protrusion is provided on an inner side surface of the holder main portion, and the screw adjusting hole penetrates through the spring receiving protrusion closer to the pair of the regulation claws than the pad receiving portion of the holder main portion.

12. The paper transportation device according to claim 11, wherein a slanting surface arranged adjacent the pair of the leg portions of the holder main portion slants towards the separating pad.

13. The paper transportation device according to claim 12, wherein a swing shaft is provided on an end portion of the pair of the leg portions located opposite from the holder main portion.

14. The paper transportation device according to claim 13, wherein the holder main portion of the separating pad holder is arranged in a concave portion of the transportation device main body facing the separating roller, and the swing shaft of the pair of the leg portions is rotatably supported by the transportation device main body.

15. The paper transportation device according to claim 14, wherein the separation pressure adjusting screw includes:

a head portion including a screwdriver receiving groove;

a flange portion adjacent the head portion and protruding in a peripheral direction;

a shaft including a screw portion; and a mounting portion screwed onto a prescribed position of the screw portion of the shaft.

16. The paper transportation device according to claim 15, wherein a portion of the shaft of the separation pressure adjusting screw is inserted into a through-hole on a bottom of the concave portion, and the mounting portion is fixed to the bottom of the concave portion.

17. The paper transportation device according to claim 16, wherein one end of the coil spring surrounds the head portion of the separation pressure adjusting screw and makes contact with the flange portion, and another end of the coil spring makes contact with the spring receiving protrusion.

18. A paper transportation device comprising:

a paper feed tray on which papers to be transported are stacked;

a paper discharge tray where transported papers are discharged;

a transportation path arranged to connect the paper feed tray and the paper discharge tray;

a separating roller and a separating pad arranged to separate a plurality of sheets of papers picked up from the paper feed tray one sheet at a time and to feed the papers one sheet at a time into the transportation path;

a separating pad holder arranged to hold the separating pad such that the separating pad is contacted against and separated from the separating roller;

a coil spring arranged to urge the separating pad holder to contact the separating pad against the separating roller under a prescribed separation pressure;

a separation pressure adjusting screw arranged to adjust the separation pressure by changing a compressed amount of the coil spring by changing a screwed-in amount of the screw;

a screw adjusting hole arranged on a top surface of the separating pad holder to adjust the screwed-in amount of the separation pressure adjusting screw from above; and a clutch mechanism arranged on the separating roller.

19. The paper transportation device according to claim 18, wherein the separation pressure adjusting screw includes:

a head portion including a screwdriver receiving groove;

a flange portion adjacent the head portion and protruding in a peripheral direction;

a shaft including a screw portion; and a mounting portion screwed onto a prescribed position of the screw portion of the shaft.

* * * * *